US005110420A

United States Patent [19]

Marshall et al.

[11] Patent Number: 5,110,420

[45] Date of Patent: May 5, 1992

[54] ELECTROCHEMICAL PROCESS

[75] Inventors: Rodney J. Marshall, Southampton; John M. Sherborne, Woking, both of England

[73] Assignee: The British Petroleum Company p.l.c., Finsbury, England

[21] Appl. No.: 777,831

[22] Filed: Oct. 15, 1991

[30] Foreign Application Priority Data

Oct. 19, 1990 [GB] United Kingdom ..... 9022828

[51] Int. Cl.[5] ..... C25D 5/00; C25D 9/04

[52] U.S. Cl. ..... 205/157; 205/316; 205/319

[58] Field of Search ..... 204/14.1, 56.1

[56] References Cited

U.S. PATENT DOCUMENTS 4,400,244 8/1983 Kroger ..... 204/2.1
4,548,681 10/1985 Hasol ..... 204/2.1
4,818,352 4/1989 Inaba ..... 204/14.1

*Primary Examiner*—T. M. Tufariello
*Attorney, Agent, or Firm*—Larry W. Evans; Joseph G. Curatolo

[57] ABSTRACT

A compound containing an element of Group IIB and of Group VIB is cathodically deposited on a cathode comprising a layer of high sheet resistance on an insulating substrate by positioning the anode relative to the cathode such that the distance from the anode to a point on the cathode increases as the distance between the point and the nearest electrical connection to the cathode decreases.

11 Claims, 4 Drawing Sheets

ELECTROCHEMICAL PROCESS

Figure 1:
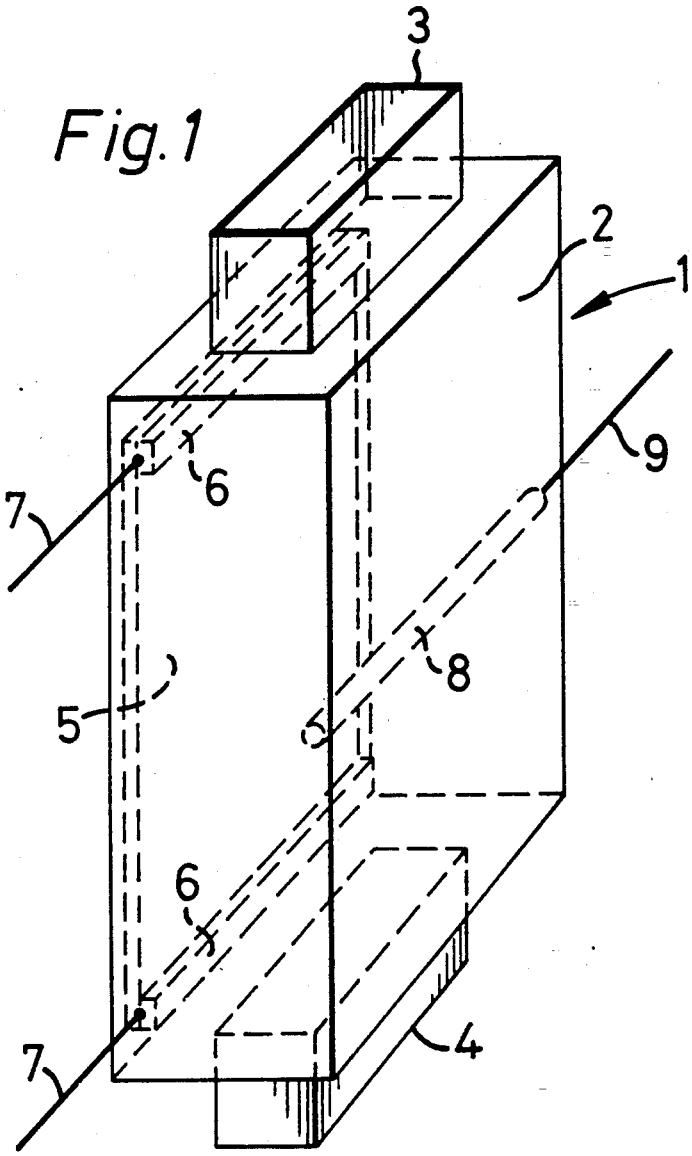

The present invention relates to the production of compounds containing elements of Group IIB and Group VIB of the Periodic Table, e.g., cadmium and tellurium, for example cadmium telluride and cadmium mercury telluride, by electrochemical deposition.

It is known that cadmium telluride may be deposited on insulating material coated with thin films of conducting oxides. Thus in the preparation of photovoltaic cells based on cadmium telluride semiconductor it is known to deposit cadmium telluride on a semiconductor which has previously been deposited on an insulating glass plate which has a coating of a conducting oxide e.g. a transparent conducting oxide e.g. $SnO_2$ or indium tin oxide (ITO). Such a process is described in for example Panicker et al., J. Electrochem. Soc; Electrochemical Science and Technology Apr. 1978, pp 567–571, and in U.S. Pat. No. 4,400,244 and U.S. Pat. No. 4,548,681. This deposition step is used in the production of photovoltaic cells in which the semiconducting layer on which the cadmium telluride is deposited is CdS.

The cadmium telluride layer is deposited by an electrochemical process in which the plate to be coated with cadmium telluride is made the cathode in a plating bath containing Cd and Te ions. The anode may be a suitable inert material. It is important to control the potential at which deposition takes place. If the potential falls outside the correct range tellurium, cadmium, or alloys or mixtures thereof is deposited and not the desired good quality, essentially single phase, cadmium telluride.

Where the substrate carrying the semiconductor layer is an insulator, as in the case of the glass plates mentioned above, electrical contact with the semiconductor layer and the underlying conducting oxide layer has been made at the edges of the layer. The layer which coats the substrate has a relatively high sheet resistance. The current which passes through the electrochemical cell during the deposition process will produce a potential drop from the connected edge of the conducting/semiconducting layer (i.e., the edge to which the electrical contact is made) across the plate so that the potential at the surface of the cathode will vary significantly depending on the distance from the point of electrical contact, so as to give layers of varying composition.

In U.S. Pat. No. 4,400,244 the specific arrangement disclosed for depositing the semiconductor involves the use of a bath in which a plate forming the cathode is suspended vertically together with one or more rods constituting the anode. Electrical connections are made to the anode and cathode at their upper ends. A similar arrangement is shown in, for example, U.S. Pat. No. 4,909,857.

We have found that using anodes and cathodes disposed and connected as above it was not possible to produce large areas of high quality cadmium telluride, as opposed to material with impaired electronic properties containing significant amounts of tellurium, cadmium, or alloys or mixtures thereof because the electrodeposition potential was not at the value needed to give high quality cadmium telluride over the whole area of the cathode.

We have now found a method of electrochemically depositing compounds containing elements of Group IIB and VIB of the Periodic Table on a low conductivity surface which at least partially compensates for the problems mentioned above and which enables layers of controlled composition to be deposited over a wider area.

According to the present invention the process for cathodically depositing a compound containing an element of Group IIB and Group VIB by electrodeposition from a bath solution containing ionic species of these elements, an anode, a cathode on which deposition takes place, the cathode comprising a layer of relatively high sheet resistance on an insulating substrate is characterised in that the anode is positioned relative to the cathode such that the distance from the anode to a point on the cathode increases as the distance between that point and the nearest electrical connection to the cathode decreases.

In this specification references to Group IIB and Group VIB are references to the Periodic Table of the Elements as appearing in "Advanced Inorganic Chemistry" by Cotton and Wilkinson, 4th Edition, in which Group IIB includes Cd, and Group VIB includes Se and Te. The preferred materials are semiconductor compounds of Cd and Te, which may also contain Hg.

The anode will in general be an elongated structure and in general the electrical connection to the cathode will extend over some distance. It will be understood that when referring to the distance between a point on the cathode and the anode or electrical connection to the cathode we are referring to the shortest distance.

In the process of the invention the increase in voltage drop across the surface of the cathode as the distance from the electrical connection to the cathode increases is at least partially compensated by the reduced voltage drop due to the resistance of the bath solution between the anode and the relevant part of the cathode. A larger area of the cathode can thus be maintained at a surface potential suitable for deposition of a high quality layer of a IIB/VIB compound.

The arrangements disclosed in the references mentioned above in which electrodes are disposed vertically in a tank and electrical connections are made at the upper ends of the electrodes are the simplest and easiest to construct. However the distance (i.e., the shortest distance) between the anode and the cathode is constant. The distance between any point on the cathode and the nearest electrical connection to the cathode increases down the length of the cathode.

Examples of inert materials which may be used for the anode are carbon and platinum-coated titanium.

The anode is preferably disposed relative to the cathode such that the shortest distance between the anode and that part of the cathode which is most remote from the electrical connection is relatively short. If the anode is spaced a considerable distance from the cathode then the differences in distance between the anode and different parts of the cathode will be relatively small and therefore the difference in resistance across the bath between the anode and various parts of the cathode may give reduced compensation for the voltage drop across the surface of the cathode due to the resistance of the cathode. The shortest distance between the anode and that part of the cathode which is most remote from the nearest electrical connection to the cathode may be, for example, not more than 80%, preferably not more than 50%, e.g., not more than 35% of the distance from the nearest electrical connection to the cathode to the part of the cathode which is nearest to the anode. The effect is particularly marked for distances in the range 5 to 10%.

In one form of the invention a baffle adjacent to the cathode confines conducting paths through the electrolyte solution in contact with the cathode to a space which is small in relation to the size of the cathode.

The baffle is disposed relative to the cathode so as to confine the conducting paths through the electrolyte bath to a relatively narrow space between the plate and the baffle. The baffle defines a space between the cathode and the baffle. This space may be of uniform width, which is a simple arrangement. However, it is also possible for the baffle and the cathode to be disposed to give a space of non-uniform width between the cathode and baffle. It is believed that it may be advantageous to arrange for the gap to increase as the distance along the cathode from the electrical connection increases.

A particularly convenient way of providing the baffle is to place the anode and cathode on opposite straight sides of a channel of insulating material, which channel is of uniform width which is small relative to the length of the cathode, for example less than 35%, e.g., less than 20% of the length of the cathode, and preferably more than 5%, and less than 10%.

As an alternative to a baffle behind the anode, i.e., on the side remote from the cathode it is possible to provide a baffle between the anode and the cathode to confine the current path so that the distance from the anode to the cathode varies in accordance with the invention. With such a baffle it is possible, for example, to arrange the anode and the cathode vertically with connections on their upper ends. The shortest current path leads between the lower end of the anode and the lower end of the cathode.

If the cathode is rectangular and is connected to the electrical supply along one edge then the anode is conveniently in the form of a rod disposed adjacent to and parallel to the opposite edge. If the cathode is rectangular and is connected to the electrical supply along two opposed edges then the anode is conveniently in the form of a rod disposed parallel to the said edges and equidistant from said edges.

If the cathode is connected to the electrical supply at several positions on the cathode the anode may be provided by more than one conducting element disposed adjacent to the regions of the cathode lying between the connections to the cathode from the electrical supply.

The greater the distance from the nearest electrical connection to the part of the cathode most remote from an electrical connection the greater the benefit of the invention. Thus this distance may be at least 300 mm.

In order to provide an arrangement in which there are significant differences in the distance between the anode and different parts of the cathode it will be convenient to use an anode which is small relative to the cathode. It should be understood that when referring to the size of the anode we are referring to the exposed or effective area from which current can flow to the cathode. For example with a rectangular cathode with electrical connections to the edges it is preferred to use an anode in the form of a rod or strip parallel to the edge to which electrical connection is made.

The magnitude of the difference in distance between the anode and different parts of the cathode required to give a useful degree of compensation for the voltage drop across the surface of the cathode will depend upon the resistivity of the conducting layer on the cathode and on the resistivity of the electrolyte solution. However the resistivity of the electrolyte solution forming the bath is usually determined by other considerations. For optimum results it is desirable to use a baffle and in such a case the spacing is preferably adjusted such that the resistance of the plate matches the calculated resistance of the bath solution. The resistance of the platecan be determined from the sheet resistance as is well known to those skilled in the art. The calculated resistance of the bath solution corresponds to rho$\times$L/A when rho is the specific resistance, L is the length of the cathode, and A is the cross sectional area of the space between the cathode and the baffle. While in general these resistances should match as closely as possible good results can be obtained when the resistance of the cathode is from, for example, 50% to 200% of the calculated resistance of the bath solution, for example, 80% to 120% of the calculated resistance.

Figure 2:
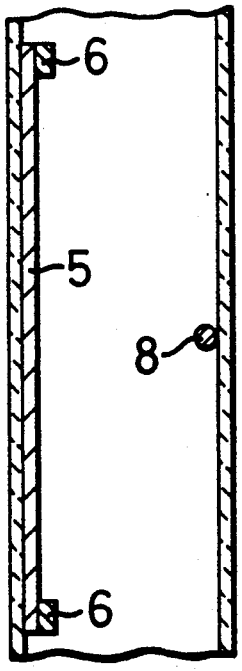
Figure 3:
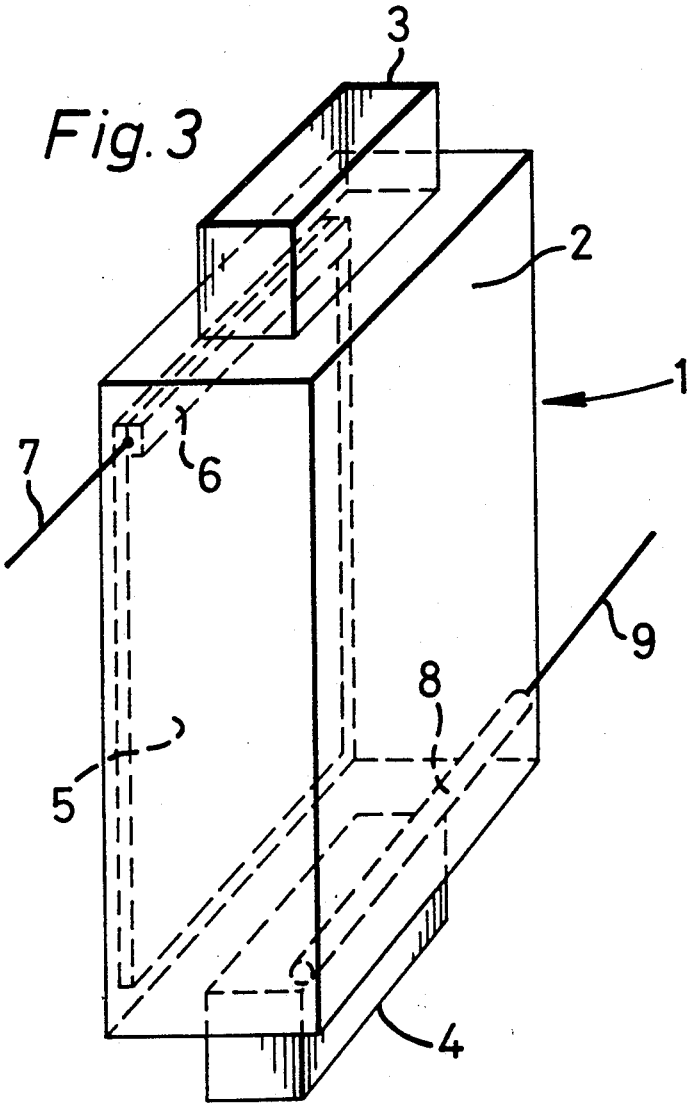
Figure 4:
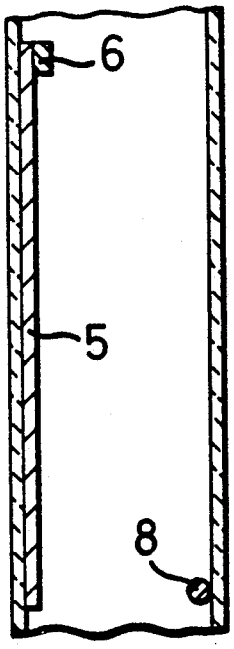
Figure 5:
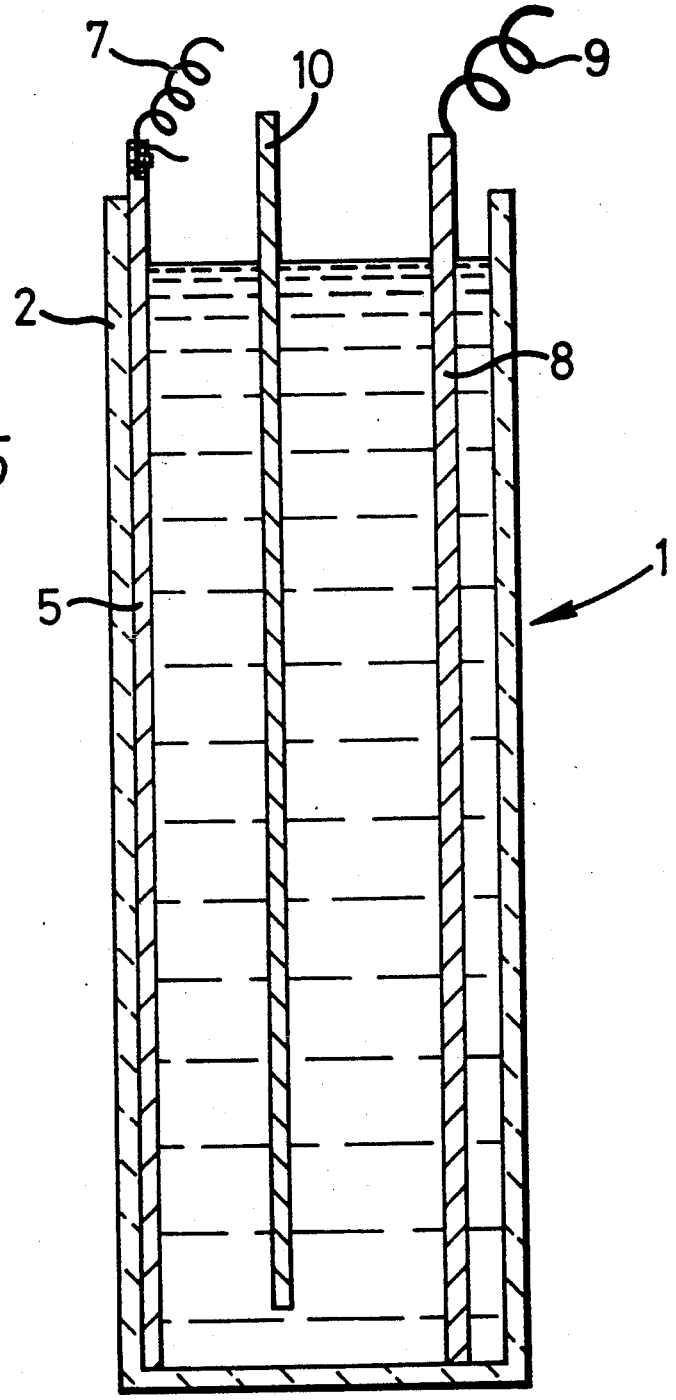
Figure 6:
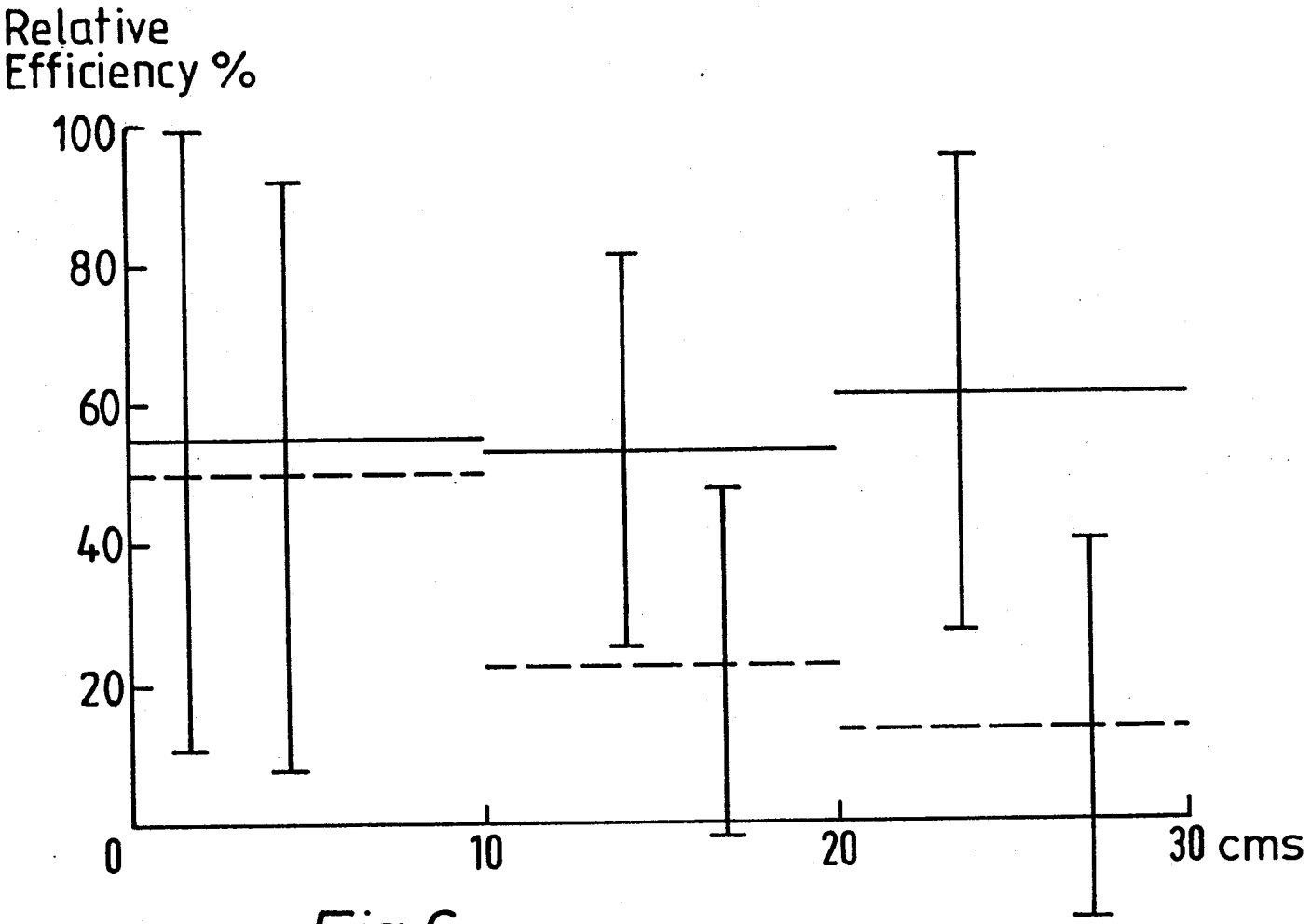

The invention will now be illustrated by reference to the accompanying drawings in which FIG. 1 is a diagrammatic perspective view (not to scale) of one embodiment of a cell for carrying out the process of the present invention, FIG. 2 is a longitudinal cross-section of part of the cell of FIG. 1 not showing the inlet and outlet, FIG. 3 is a diagrammatic representation of another embodiment of the present invention, and FIG. 4 is a longitudinal cross-section of part of the cell of FIG. 3 not showing the inlet and outlet, FIG. 5 is a diagrammatic cross-section (not to scale) of another form of the invention, and FIG. 6 is a graphical representation of the variation of relative efficiency of photovoltaic cells fabricated from CdTe semi conductor deposited on the cathode with distance from the electrical connection to the region of the cathode used to make the cell.

Referring to FIG. 1 an electrochemical cell indicated generally at (1) comprises a channel of rectangular cross-section defined by a glass vessel (2) and having means for introducing and removing electrolyte indicated generally at (3) and (4). The cell is shown arranged vertically but could equally be disposed horizontally.

The depth of the channel formed between the walls of the vessel was 40 mm. This corresponded to the shortest distance from the anode to the cathode being 27% of the shortest distance from the electrical connector to a point on the cathode nearest the anode.

The electrolyte was agitated by a mechanical stirrer and pumped through the cell at a rate of 0.75 liters/min.

Within the vessel (2) is disposed a rectangular cathode (5), held in place by clamping means (not shown).

The cathode has a length and breadth of 300 mm and a thickness of about 2 mm. It comprises an insulating glass plate coated in turn with a conducting oxide and a semiconductor layer. Electrical contact is made to opposed edges of the cathode by conducting strips (6) at the ends of the cathode connected to electrical conductors (7) passing through the vessel.

An inert anode (8) of platinum-coated titanium is mounted on the wall of the vessel opposite the cathode. It consists of a rod of platinum-coated Ti of diameter abount 6 mm and is disposed so as to be equidistant from the edges of the cathode provided with electrical connections. It is connected to a conductor (9) extending outside the glass vessel.

The arrangement shown in FIGS. 3 and 4 is substantially the same except that electrical connection is made only to one edge of the cathode and the anode is disposed adjacent to the opposed edge of the plate. This arrangment will allow approximately half the area coverage (for obtaining good quality material) possible with the arrangment of FIGS. 1 and 2.

Referring to FIG. 5 an electrochemical cell (1) comprises an insulating vessel (2), provided with means (not shown) for pumping electrolyte through the vessel, and a rotating rod (not shown) to agitate the electrolyte. A rectangular cathode (5) of length 300 mm is disposed vertically within vessel (2). Electrical contact is made to the top edge of the cathode by a conducting strip (6) connected to an electrical conductor (7). An inert anode (8) consisting of a rod of Pt-coated Ti is disposed vertically within the vessel. It is connected to an electrical connector (9).

A baffle (10) is disposed vertically between the cathode so that the electrolyte surrounding the anode can only communicate with the electrolyte surrounding the cathode through a gap at the bottom of the anode as shown in FIG. 5. The distance from the cathode to the baffle is 20 mm. The distance between the bottom of the baffle and the base of the cell is not critical, and may, for example, be between 1 and 5% of the length of the cathode. Thus in the specific arrangement described above the gap was of the order of 10 mm.

EXAMPLE 1

A square glass plate (300 mm×300 mm×1.9 mm) was coated with a transparent conducting oxide ($SnO_2$) with a sheet resistance of 10 ohms per square was coated with a layer of cadmium sulphide by chemical deposition as described by G. A. Kitaev et al, Russ. J. Phys, Chem. 39, 1101 (1965). Narrow edge strips free of CdS were formed by etching with dilute HCl. Electrical contact to the plate was made by way of cadmium foil strips covered with a self-adhesive polyimide tape.

The coated glass plate was then used as a cathode in the apparatus shown in FIGS. 1 and 2 and plated with CdTe. The plating conditions were described in U.S. Pat. No. 4,400,244 and U.S. Pat. No. 4,548,681 except that Te was added as $TeO_2$ and that a platinised titanium anode was used. The electrode potential corrected for resistive losses was held at 0.5 V relative to the Ag/AgCl reference electrode. CdTe was deposited for 6 hours. The plate was then heat-treated as described in U.S. Pat. No. 4,388,483, and then etched as described in U.S. Pat. No. 4,456,630 prior to thermal evaporation of 2 $mm^2$ area gold dots through a shadow mask.

The light conversion efficiencies of 81 photovoltaic cells across and down the plates were measured under 100 $mW/cm^2$ white light illumination and the averaged results for different parts of the plate shown in Table 1. The high degree of uniformity of cell efficiency confirmed uniform properties of the electrodeposited CdTe layer.

TABLE 1

| | Cell Efficiencies % | | | |
|---|---|---|---|---|
| | Left | Middle | Right | |
| Top | 11.0 ± 1.3 | 11.3 ± 0.7 | 11.2 ± 1.3 | Top |
| Middle | 11.3 ± 0.6 | 11.0 ± 0.2 | 11.2 ± 1.0 | Middle |
| Bottom | 11.6 ± 1.3 | 12.2 ± 1.1 | 11.2 ± 1.0 | Bottom |

The average over the whole plate was 11.33%.

EXAMPLE 2

An experiment was carried out using the apparatus of FIG. 5, but using the same type of cathode as in Example 1 (glass/tin oxide/CdS) (20×300 mm) and with the same electrolyte composition as in Example 1. Electrodeposition using a reference electrode and solar cell efficiency measurements were carried out as in Example 1. The results are shown in FIG. 6 by continuous lines representing the efficiencies measured, relative to an arbitrary standard, for photovoltaic cells fabricated from three different sections of the cathode corresponding to different distances from the point of electrical connection to the cathode. Error bars showing the range of error likely in the measurements are also shown.

COMPARATIVE TEST A

An experiment was carried out as in Example 2 except that there was no baffle so that the effective distance from the anode to the cathode was constant.

The results are shown in FIG. 6 by dotted lines.

A comparison of the results for Example 2 with that of Test A shows the improved uniformity obtained using the present invention.

We claim:

1. The process for cathodically depositing a compound containing at least one element of Group IIB and at least one element of Group VIB by electrodeposition from a bath solution containing ionic species of these elements containing an anode, a cathode on which deposition takes place, the cathode comprising a layer of relatively high sheet resistance on an insulating substrate is characterised in that the anode is positioned relative to the cathode such that the distance from the anode to a point on the cathode increases as the distance between that point and the nearest electrical connection to the cathode decreases.

2. The process according to claim 1 wherein a compound containing cadmium and tellurium is deposited from a bath solution comprising ions containing Cd and ions containing Te.

3. The process according to claim 2 wherein the distance between the anode and that part of the cathode which is most remote from the nearest electrical connection to the cathode is not more than 80% of the distance from the nearest electrical connection to the cathode to the part of the cathode which is nearest to the anode.

4. The process according to claim 3 wherein a baffle adjacent to the cathode confines conducting paths through the bath solution between the anode and cathode to a space between the anode and cathode which is narrow in relation to the size of the cathode.

5. The process according to claim 4 wherein there is a space of constant width between the baffle and the cathode.

6. The process according to claim 4 wherein the space between the baffle and the cathode increases as the distance along the cathode from the electrical connection increases.

7. The process according to claim 4 wherein the baffle is provided by placing the anode and cathode on opposite sides of a straight sided vessel of insulating material, which vessel defines a channel of uniform width which is small relative to the length of the channel.

8. The process according to claim 4 wherein the width of the channel is less than 35% of the length of the cathode.

9. The process according to claim 5 wherein the width of the channel is less than 20% of the length of the cathode.

10. The process according to claim 1 wherein the cathode is a rectangular plate with four edges and the anode is an elongated member which extends parallel to an edge connected to an electrical supply.

11. The process according to claim 10 wherein the cathode is rectangular and is connected to an electrical supply along two opposed edges and the anode is in the form of a rod or strip disposed parallel to the edges and equidistant from said edges.

* * * * *